US005240074A

United States Patent [19]

Peavy et al.

[11] Patent Number: 5,240,074

[45] Date of Patent: Aug. 31, 1993

[54] METHOD FOR SELECTIVELY CONTROLLING FLOW ACROSS SLOTTED LINERS

[75] Inventors: Mark A. Peavy, Plano; John M. Dees, Richardson, both of Tex.

[73] Assignee: Oryx Energy Company, Dallas, Tex.

[21] Appl. No.: 834,888

[22] Filed: Feb. 11, 1992

[51] Int. Cl.[5] ..... E21B 33/13; E21B 43/12

[52] U.S. Cl. ..... 166/286; 166/295; 166/299; 166/300; 166/50

[58] Field of Search ..... 166/50, 63, 241.6, 250, 166/254, 286, 295, 296, 299, 300

[56] References Cited

U.S. PATENT DOCUMENTS

| | | | |
|---|---|---|---|
| 1,592,104 | 7/1926 | Hallvarson . | |
| 2,556,169 | 6/1951 | Crouch et al. | 166/295 |
| 3,134,436 | 5/1964 | Means et al. | 166/295 |
| 3,316,966 | 5/1967 | Dear, Jr. | 166/295 |
| 3,386,510 | 6/1968 | Schnabel, Jr. . | |
| 3,526,280 | 9/1970 | Aulick | 166/241.6 X |
| 3,713,393 | 1/1973 | O'Connor et al. | 166/63 X |
| 4,202,411 | 5/1980 | Sharp et al. | 166/296 X |
| 4,239,084 | 12/1980 | Sharp et al. | 166/278 |
| 4,928,763 | 5/1990 | Falk | 166/250 |
| 5,101,900 | 4/1992 | Dees | 166/300 X |
| 5,145,013 | 9/1992 | Dees et al. | 155/295 |

*Primary Examiner*—George A. Suchfield

*Attorney, Agent, or Firm*—Pravel, Hewitt, Kimball & Krieger

[57] ABSTRACT

A method for plugging and unplugging the slots or openings in slotted liners in wells is provided. A resin is coated onto the slotted liner by using an explosive to disperse the resin from an elongated container onto the surrounding slotted liner.

17 Claims, 1 Drawing Sheet

METHOD FOR SELECTIVELY CONTROLLING FLOW ACROSS SLOTTED LINERS

BACKGROUND OF THE INVENTION

Field of the Invention

This invention relates to wells and means for modifying or controlling flow of fluids into or out of selected intervals of a wellbore. Specifically, it is a method to place, by firing an explosive, liquid resin in selected intervals of slotted liner devices in the wellbore such that the resin polymerizes to reduce radial flow across the selected interval of the wellbore boundary and later, if desired, to remove by explosive the polymerized resin thereby increasing the radial flow across the same interval.

Description of Related Art

Wells drilled through unconsolidated rock formations or formations that may collapse into the wellbore are often equipped with slotted liners, which are pipes having narrow slots cut either axially or transverse in the wall of the pipe. The liner extends to a point above the formation where fluid is to be produced or injected. The slots are made sufficiently narrow to exclude particles greater than a selected size while allowing flow into or out of the wellbore. When slotted liners are placed in wells, it is common, but not essential, to place granular material, called "gravel," in the annulus outside the slotted liner. The gravel particles are sized larger in diameter than the slot width. The gravel serves to decrease plugging of the slots by grains of formation rock and finer materials from the formation moving with produced fluids.

In processes for recovering oil, gas and other minerals from wells, it is often desirable to control fluid flow rate into or out of a well in selected intervals along the wellbore. In flooding processes for recovery of oil, for example, the injected fluid often channels through more permeable zones and begins flowing into a producing well prematurely. It is desirable to block or partially block flow of fluid into or out of the zone where the injected fluid has channeled. In thermal recovery processes in which steam is injected into a reservoir to heat the viscous oil and increase recovery rate, it is desirable to decrease flow of steam or condensed steam into a well in intervals where oil has been displaced and to divert the flow of hot fluids to zones having high oil saturation.

A variety of methods have been proposed for decreasing flow rates in selected intervals of wellbores. Some methods involve injection of a polymer solution into the rock surrounding the well. Such methods are applicable in wells with or without slotted liners in the wellbore, but it is difficult to cause the polymer solution to flow into the interval where it will be most effective, particularly in wells having slotted liners. Injection of cement into perforations in the casing of the well is also often employed when the well contains perforated casing, but when slotted liners are inside the wellbore this procedure is not effective. Mechanical methods, generally involving placement of packers at selected depths in the wellbore, also are not effective in wells having slotted liners. Mechanical methods also require use of a workover rig and are relatively expensive.

The production of fluids from horizontal wells or wells drilled at a substantial angle with respect to vertical has recently become common. We use the term "horizontal well" for any well in which the maximum angle from vertical of any segment of the wellbore is greater than about 70 degrees. Such horizontal wells are often completed with slotted liners in the productive zone. In these wells, production of an unwanted fluid often occurs through the slotted liner in some intervals of the wellbore. The interval in which the unwanted fluid enters the wellbore may be known from other data or may be determined by running a flowmeter along the wellbore. It is particularly advantageous to decrease influx into the well in the selected interval producing the unwanted fluid.

In a vertical or horizontal well, it is possible that in a treatment to decrease unwanted flow, production rate of a wanted fluid may be decreased. It will then be particularly important to remove at least a portion of the effects of the treatment.

U.S. Pat. No. 1,592,104 discloses apparatus and method for blasting a cement into the walls of an open hole drilled through the earth. The method is claimed to stabilize the walls of the borehole to prevent collapse. An explosive cartridge is surrounded with a plastic cementing material which is then contained in a collapsible lining.

There has long been a need for an inexpensive method of selective plugging or partially plugging selected intervals of a well having a slotted liners in the wellbore. Preferably, the method would be reversible, such that an interval selectively plugged could be reopened for production or injection.

SUMMARY OF THE INVENTION

In one embodiment, there is provided a process for decreasing flow rate across the radial boundary of a selected interval of a wellbore containing a slotted liner by placing in the selected interval an elongated container containing resin or resin solution and a detonating cord. The cord is fired to cause the resin to coat the surrounding slotted liner in the well. When the resin has cured, flow is initiated in the well and the flow rate across the selected interval is decreased with respect to other intervals in the wellbore. In another embodiment, after a sand exclusion device in a well has been coated and the resin is allowed to cure to decrease flow rate in the selected interval, the flow rate in the interval is at least partially restored by firing an explosive in the same interval of the wellbore. In yet another embodiment, an elongated container with resin and a detonating cord is placed in an interval producing unwanted fluid in a horizontal well, the detonating cord is fired and the resin is allowed to cure to decrease flow rate of unwanted fluids into the horizontal wellbore.

DESCRIPTION OF PREFERRED EMBODIMENTS

Figure 1:
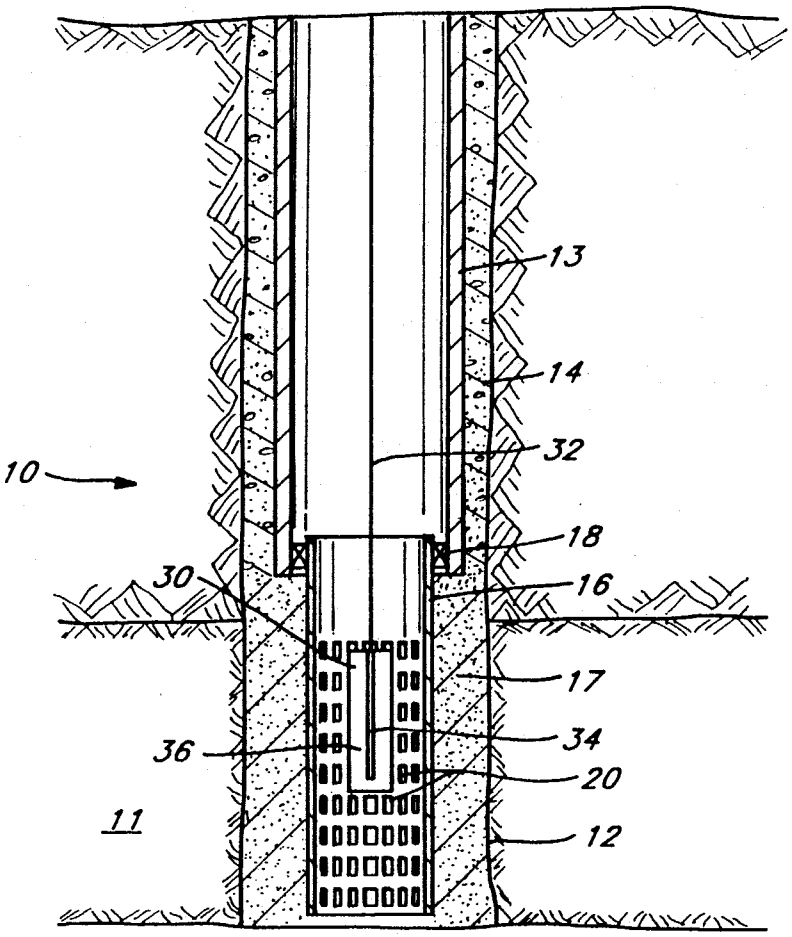
FIG. 1 is a sketch of a wellbore equipped with a slotted liner and a gravel pack in the open hole, showing an elongated container having resin and a detonating cord before the explosive is fired.

Referring now to FIG. 1, well 10 is shown drilled through the earth into formation 11 where fluid will be injected or extracted by flow across wellbore boundary 12. The well has been drilled and casing 13 has been placed in the well and cemented in place with cement 14. Liner 16 has been placed below casing 13 and gravel 17 has been placed in the annulus between the liner 16 and the wellbore boundary 12. The gravel is placed by techniques well known in the art. Liner hanger 18 then is actuated to seal the overlap between the casing 13 and the liner 16. The liner contains slots 20, which are sized to prevent flow of gravel 17 through the liner 16.

In the process of our invention, explosive 34 is placed in elongated container 30 along with resin solution 36. The container 30 may be rigid plastic such as polyvinyl chloride pipe or a metal pipe with holes and with a plastic bag or pipe inside to contain the liquid resin. If a metal pipe is used as elongated container 30, holes should be drilled such that the spray of resin from the holes when the explosive 34 is fired will cover the circumference of the liner 16 enclosing the metal pipe 30. The holes should be from about ¼ to about ¾ inch in diameter, with from about 4 to about 32 holes per foot. The diameter of the metal pipe 30 should be from about 2 inch to a size which is less than about three-fourths the diameter of the liner 16.

If a rigid plastic pipe is used as the elongated container 30, common polyvinyl chloride pipe is adequate for low temperature wells. A stable high-temperature plastic such as epoxy or polysulfone can be used for higher temperature wells. The plastic may contain glass or other filler.

The resin solution 36 placed in elongated container 30 is internally catalyzed. A suitable resin is epoxy. Other suitable resins are of the furan and phenolic types. The hardener or catalyst which causes the resin to polymerize or cure is incorporated into the resin at a concentration that produces a desirable pot life. Suitable resins and hardeners or catalysts are well-known in the industry. The pot life of the resin should be long enough to allow the resin to be placed in the well and the explosive fired before the resin gels, but short enough to allow the well to be produced without undue delay. Preferably, the pot life of the resin is from about ¼ hour to about 12 hours under temperature conditions expected when the resin is placed in the well. The resin is also selected to be stable under temperatures expected in the well. For example, if the well is to be used in a steam recovery process, very high thermal stability resin, known in the art, is selected.

The resin solution 36 may be only a liquid resin or it may contain additives to increase or lower viscosity, create a higher gel strength in the resin, or increase the wetting of the surfaces of the slotted liner 16 by the resin. The terms "resin" and "resin solution" are used interchangeably herein, as it is understood that these terms describe a mixture of materials having a component which is liquid until polymerization occurs to form a solid. Viscosity and gel strength influence the amount of movement of the resin and the thickness of the resin layer after it is dispersed onto the surface of the well equipment. Viscosity and gel strength should be sufficient to decrease the drainage of the resin from the interval where it is initially placed. The use of diluents in resins to decrease viscosity or gel strength is well-known. Reactive diluent may be used for improved properties of the cured resin. Experiments may determine the need for and the amount of a diluent, if any, in the resin. A gelling agent may be added to obtain greater gel strength. Finely divided solids such as fumed silica are a suitable gelling agent. Improved wetting of the surface of the slotted liner may be obtained by adding agents such as silane bonding agents to the resin.

The elongated container 30 is lowered into the well 10 on wireline 32, using conventional industry equipment. The container 30 is placed at the selected interval in the liner where it is desired to decrease fluid flow across the boundary of the wellbore 12. The length of elongated container 30 and explosive 36 is selected to correspond to the portion of the interval where unwanted fluid is entering the well 10. The location and length of this interval may be determined by measuring flow rate of different fluids at different depths in the well. Flow meters for this purpose are widely available in industry. An interval where unwanted fluid is entering the wellbore at greater than average rates will be selected for applying the methods of our invention. In injection wells, intervals where flow is unusually high will be selected for applying the methods of our invention.

Explosive 34 is fired by a signal sent through wireline 32 from the surface of the earth to a detonator. Well-known techniques are used for firing explosives in wells. A convenient and satisfactory explosive is a detonating cord sold under the name "PRIMACORD". It is desirable that the explosive be in an elongated shape extending over at least most of the length of the container. The purpose of the explosive is to create a high pressure and a volume of gas which discharges the resin 36 from the elongated container 30 through holes in the container (not shown) or which disintegrates the elongated container, allowing the resin to disperse on the inner surface of the slotted liner.

A variety of chemicals can be used for explosives in the process of this invention. For example, detonating cords can be made with RDX, PETN, HMX and other explosives. A detonating cord is particularly convenient for our process. A deflagration, produced by propellants, can also be effective. The burn rate of such materials is much slower than that of a detonation. Binders are often used with explosive chemicals to produce propellants. Other chemicals commonly used in rocket fuels are also effective for propellants. Both type reactions, detonations and deflagrations, are referred to herein as explosions, and the materials used to produce these reactions are referred to as explosives. For our invention, the amount of gas produced must be adequate to cause the resin to be dispersed through the wellbore and impinge upon the surrounding slotted liner.

It is not required for our invention that gravel 17 be present outside the slotted liner 16. If gravel 17 is not present, the surrounding formation 11 will move radially inward to fill the space indicated by gravel 17 in FIG. 1. It is preferred that a solid material be in contact with the outside surface of slotted liner 16, such that high resistance to fluid flow in the axial direction, along the wellbore, will be present. This high resistance will minimize flow of unwanted fluids in the annulus outside the slotted liner such that flow around the interval of the slotted liner 16 which has been coated with resin will be minimized.

Before or concurrent with the elongated container 30 being in place opposite the interval where flow of fluid across the wellbore boundary 12 is to be decreased, and before the explosive in the container is fired, means for decreasing flow across the radial boundary of the wellbore and across the slotted liner is preferably applied. No flow or very slight flow rate through the slots 20 will allow the resin to remain and cure in the slots 20 of the liner 16. The well is preferably closed in to flow at the surface. If the wellbore is filled with liquid and if the pressure in the formation 11 is greater than the pressure of the column of liquid when the well is closed in to flow, flow through the slots 20 will be stopped or minimized when the well is closed in to flow at the surface. If the wellbore is not filled with liquid or pressure in the formation is not greater than the pressure of the column of liquid, the well is preferably allowed to reach as near pressure equilibrium as practical such that flow through the slots 20 will be at a low rate when the explosive 34 is fired. This condition is achieved by not producing or injecting fluids into the well for a time before the explosive 34 is fired, thereby minimizing the pressure differential across the slotted liner in the wellbore. Fluid flow through the slots can be decreased further by a variety of means. In one method, small particles suspended in fluid are pumped into the well before explosive 34 is fired. The particles are sized such that they pass through the slots 20 and the gravel 17 and form a filter cake (not shown) on the boundary of the wellbore 12. A slight excess pressure inside the wellbore while the explosive 34 is fired then allows very low flow rate through the slots 20 until the resin cures. In another method, a slug of gelled fluid (not shown) is pumped down the well to a location above the elongated container 30. The high flow resistance of the slug prevents further fluid movement through the slots 20 until the resin cures. No substantial flow rate of fluid should occur across the slotted liner in the wellbore after the explosive is fired until a time sufficient for the resin to cure. After curing, the resin has sufficient shear strength to prevent displacement of the resin from the slots or other openings of the slotted liner. Therefore, the well should not be opened to flow until after the cure time of the resin. Cure time of the resin can be determined by laboratory tests of resin flow or mechanical strength properties versus time under temperature conditions of the resin expected in the well.

Figure 2:
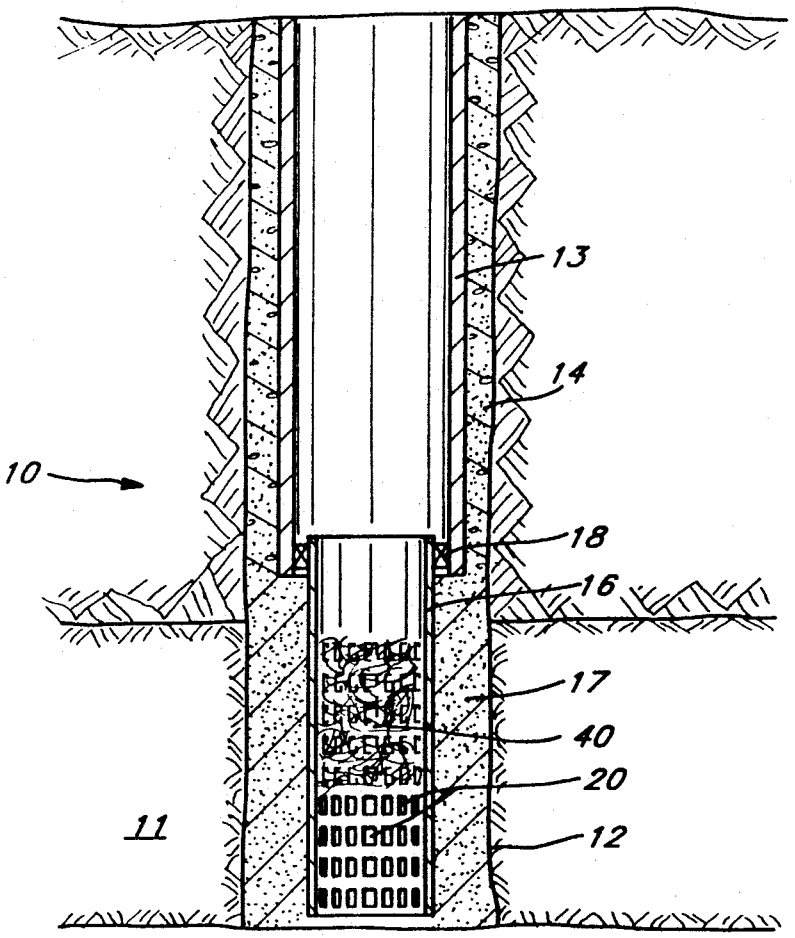
FIG. 2 is a sketch of a wellbore equipped with a slotted liner and a gravel pack in the open hole, showing resin coating the slots of the slotted liner after the explosive is fired.

FIG. 2 shows the same well 10 after the explosive in the elongated container has been fired. The resin has now been dispersed and coats the surface of the slotted liner 16 over the interval where the elongated container was present, as shown at 40. The wireline and elongated container have been withdrawn from the well. The flow across interval 40 is now greatly reduced or eliminated by the resin coating 40 after the resin has cured. The flow of fluid entering the well 10 from the top portion of the formation 11 is, therefore, greatly reduced. An unwanted fluid entering through this interval may be natural gas, steam, water or any other fluid in the formation 11. Other numerals shown in FIG. 2 define the same parts as shown in FIG. 1.

FIG. 2 shows placement of resin to decrease flow from the top portion of a vertical wellbore, but it should be understood that our process can be used effectively in any interval of the wellbore. For example, the process as shown in FIG. 2 would be employed to decrease flow of an unwanted fluid which is less dense than the desired fluid, such as gas or steam flowing into an oil well, or in the case of more permeable zones of the formation at the top of the formation 11. The process could just as well be used to decrease flow of an unwanted fluid which is more dense than the desired fluid, such as water flowing into an oil well from the bottom of the formation 11, by placing the elongated container over the interval at the bottom of the formation 11.

The process of our invention can be used in horizontal wellbores. Production of unwanted gas or water into horizontal oil wells is often observed. The interval where these unwanted fluids enter the horizontal wellbore can be identified by measuring flow rate of oil, water and gas into the wellbore at different locations along the wellbore. Our invention provides a method to shut off or greatly decrease flow of these unwanted fluids into the horizontal well by placing an elongated container 30 such as shown in FIG. 1 in the interval producing the unwanted fluids and firing an explosive such as 34 shown in FIG. 1. In a horizontal well, the container 30 would normally be placed in the well by the use of coiled tubing, using techniques well-known in industry for placing logging instruments in wells. The explosive would preferably be fired using a firing head which may be pressure-actuated, using techniques well known in industry.

Especially for use in a horizontal well, an elongated container such as shown at 30 in FIG. 1 preferably has attached to it devices for centralizing the container within the wellbore. Such devices as spring centralizers, commonly used and well known in industry to centralize logging instruments, for example, are adequate. Two or more centralizers are preferred, with at least one centralizer at each end of the elongated container. The flow of fluid across the wellbore boundary before the explosive is fired should be minimized for the horizontal well, as was described for the vertical well.

EXAMPLE 1

A 2⅞ inch diameter, 6.5 pounds per foot, N-80 metal pipe was cut to a length of 6 feet and ½ inch diameter holes were drilled over the middle 4 feet of the pipe at a density of 16 holes per foot. The pipe was welded shut at the bottom and threaded at the top to form an elongated container. PVC pipe of 2-inch diameter was placed inside the metal pipe, this pipe being closed at the bottom. A string of "PRIMACORD" was then placed in the plastic pipe and the pipe was filled with a mixture of epoxy resin and hardener. A detonator was attached to the "PRIMACORD". The detonator wires were pulled through a threaded bullplug cap handling sub which was then screwed on the pipe and the wires were attached to an electric wireline unit.

The resin was EPON 815, an epoxy manufactured by Shell Chemical Company. The hardener was "U-type," mixed at a ratio of 6:1 epoxy to hardener. The "PRIMACORD" contained 25 grains per foot of RDX explosive.

The testing facility consisted of a 16 inch diameter section of pipe placed within a test cell at ambient temperature. A 5½ inch diameter, 7 feet long, slotted pipe, simulating a slotted liner in a well, was placed inside the 16-inch pipe. The axial slot dimensions in the pipe were 30-mesh width by 2 inch length, spaced on 6-inch centers.

The elongated container consisting of the concentric metal and plastic pipe sections was lowered into the slotted pipe section in the test facility. The explosive was fired by a signal sent through the electric wireline and the elongated container was withdrawn. The slotted pipe was then withdrawn and inspected. The epoxy was still tacky after 25 minutes, but the epoxy resin was evenly dispersed over the slotted pipe and filled the slots. After the resin cured, the slotted pipe was filled with water and was found to be completely sealed to water flow.

A 4-foot length of "PRIMACORD" having 14 grains per foot explosive was placed inside the slotted pipe which had been sealed with the resin and filled with water. The "PRIMACORD" was then fired. This procedure was repeated with a second 4-foot length of "PRIMACORD". Then water was introduced into the liner as water leakage rate from the liner was observed. Visual inspection of the liner showed that 50 to 85 per cent of the casing slots initially sealed by resin were re-opened by the explosive charges.

EXAMPLE 2

Vertical wells are used for recovery of viscous oil by steam flooding a formation 50 feet thick. Steam breakthrough occurs in production wells after recovery of only 5 per cent of the oil in place. It is suspected that steam channelling is occurring over the top of the formation containing the oil. The production wells contain an open-hole gravel pack and slotted liners. An elongated container of metal pipe 8 feet in length and $2\frac{7}{8}$ inch in diameter is prepared by drilling 150 holes $\frac{3}{4}$ inch in diameter around the perimeter of the pipe and over almost its entire length. The pipe has one welded closed end and one end having a threaded cap adapted for attachment to a wire line with electrical contact going through the cap. A thin-wall plastic pipe made of polysulfone is fitted inside the metal pipe. A 7-foot long string of "PRIMACORD" having 25 grains per foot of explosive and a detonator are placed inside the plastic pipe. The pipe is then filled with high-temperature epoxy resin having a pot life of 2 hours when heated from 75 degrees F. to 250 degrees F. in 1 hour. The cap is placed on the open end and electrical connections are made to the detonator. The well is closed in to production for two days. The elongated container is then lowered on wire line to the top of the slotted liner in the production well and the explosive is fired by an electrical signal from the surface. The wire line is then withdrawn and after six hours the well is opened to production. The steam-to-oil ratio from the well is decreased from 50 to 10 by the treatment. After 2 months, the treatment is repeated except with the elongated container placed over 10 feet below the 8-foot interval of the first treatment. The steam-to-oil ratio is again decreased from 40 to 8 by the second treatment.

The invention has been described with reference to its preferred embodiments. Those of ordinary skill in the art may, upon reading this disclosure, appreciate changes or modifications which do not depart from the scope and spirit of the invention as described above or claimed hereafter.

What we claim is:

1. A process for decreasing flow rate across the radial boundary of a selected interval in a wellbore containing a slotted liner comprising:

placing an explosive and an internally catalyzed resin solution inside an elongated container;

locating the elongated container opposite the selected interval in the wellbore where flow rate through the slotted liner is to be decreased;

firing the explosive; and allowing the resin to cure on the slotted liner before initiating flow through the well.

2. The process of claim 1 wherein the resin solution placed in the elongated container comprises an epoxy resin.

3. The process of claim 1 wherein the resin solution placed in the elongated container comprises a furan resin.

4. The process of claim 1 wherein the resin solution placed in the elongated container comprises a phenolic type resin.

5. The process of claim 1 wherein the elongated container is a rigid plastic pipe.

6. The process of claim 1 wherein the elongated container is comprised of an elongated plastic container inside a metal tube containing holes.

7. The process of claim 1 wherein the explosive is a detonating cord having in the range from about 10 to about 300 grains per foot of explosive material.

8. The process of claim 1 wherein the resin solution contains a bonding agent.

9. The process of claim 1 wherein the resin solution contains a diluent.

10. The process of claim 1 wherein the resin solution contains a gelling agent.

11. The process of claim 1 wherein a centralizing device is attached to the elongated container before it is placed in the well.

12. The process of claim 1 wherein means for decreasing flow across the radial boundary of the wellbore is applied before firing the explosive.

13. The process of claim 1 wherein the steps are repeated in the same well.

14. The process of claim 1 further comprising:

locating an explosive opposite the selected interval and inside the slotted liner after the resin has cured and firing the explosive.

15. The process of claim 14 wherein the steps of locating and firing the explosive are repeated in the same interval.

16. A method for decreasing production of unwanted fluids from a horizontal well containing a slotted liner comprising:

placing an explosive and an internally catalyzed resin inside an elongated container;

placing the elongated container opposite an interval in the horizontal well where unwanted fluid is entering the wellbore through the slotted liner;

firing the explosive; and permitting the resin to cure on the slotted liner before initiating flow in the well.

17. The method of claim 16 further comprising:

before the elongated container is placed in the well and while the well is producing fluids, determining an interval of flow of unwanted fluid along the horizontal portion of the well.

* * * * *